US008205981B1

(12) United States Patent
Marino et al.

(10) Patent No.: US 8,205,981 B1
(45) Date of Patent: Jun. 26, 2012

(54) SYSTEM AND METHOD FOR SINGLE PASS PRINTING ON TEXTILES

(75) Inventors: Robert Marino, Louisville, KY (US); Fred Edward Durham, III, Foster City, CA (US); Christopher Allen Freeman, Louisville, KY (US)

(73) Assignee: CafePress Inc., San Mateo, CA (US)

( * ) Notice: Subject to any disclaimer, the term of this patent is extended or adjusted under 35 U.S.C. 154(b) by 537 days.

(21) Appl. No.: 12/163,990

(22) Filed: Jun. 27, 2008

Related U.S. Application Data

(60) Provisional application No. 60/937,780, filed on Jun. 29, 2007.

(51) Int. Cl.
*B41J 2/01* (2006.01)

(52) U.S. Cl. ..... 347/101; 347/5; 347/8; 347/9; 347/12; 347/20; 347/102

(58) Field of Classification Search ..... 347/101, 347/102
See application file for complete search history.

(56) References Cited

U.S. PATENT DOCUMENTS

2004/0252173 A1* 12/2004 Ben-Zur et al. ..... 347/101
* cited by examiner

*Primary Examiner* — Ryan Lepisto
(74) *Attorney, Agent, or Firm* — Nixon & Peabody LLP

(57) ABSTRACT

Systems and methods are described for printing directly onto textiles including digitally printing an image in a single pass. The systems and methods provide for printing in one pass, thereby reducing distortion from movement of the textile or misalignment of the print head(s). The systems and methods provide for a second print head that may operate as a redundant print head.

14 Claims, 2 Drawing Sheets

SYSTEM AND METHOD FOR SINGLE PASS PRINTING ON TEXTILES

RELATED APPLICATIONS

The present application claims priority from U.S. Provisional Application Ser. No. 60/937,780 filed Jun. 29, 2007, which is incorporated herein by reference in its entirety for all purposes.

FIELD OF THE INVENTION

The present invention relates to systems and methods for digital printing on textiles. More particularly, the present invention relates to improved systems and methods for ink jet digital printing on all types and colors of textiles.

BACKGROUND OF THE INVENTION

Systems and methods for ink jet printing on textiles are well known. "Direct to garment" printing provides for the production of an image by placing ink drops on the textile (garment) at distinct adjacent sites. This method of digital printing on textiles normally features an inkjet printer which applies ink on top of the textile. Herein a textile is a flexible material comprised of a network of natural or artificial fibers often referred to as thread or yarn. Yarn is produced by spinning raw wool fibers, linen, cotton, or other material on a spinning wheel to produce long strands known as yarn. Textiles are formed by weaving, knitting, crocheting, knotting, or pressing fibers together. When applied, the ink penetrates the textile saturating the fibers which is desirable for the image to be wash fast, meaning the ink does not rinse away when the textile is laundered.

Ink is delivered to the textile through print heads in a manner similar to that employed by standard inkjet printers used for printing on paper products. Changes in textile thickness, print heads settings, and image size as well as environmental changes and different weaves from different mills impact the application of the image on the textile. It is desirable to minimize the distortion or inconsistency of images. In addition, current methods do not allow a means for changing ink heads in the middle of a print process, therefore the process must be stopped, the head removed, replaced and realign before the beginning the print process again. Performing these steps is difficult and can compromise the printing of the current image. Whereas current systems and methods require multiple passes, embodiments of the present invention provide novel systems, methods and devices for printing an image on a textile in a single pass. Embodiments of the present invention further provide novel systems and methods for adjusting and changing ink heads during a print process.

BRIEF SUMMARY OF THE INVENTION

In accordance with an embodiment of the present invention, systems and methods for printing directly on textiles is provided including digitally printing an image in a single pass.

In accordance with another embodiment of the present invention, systems and methods for printing directly on textiles is provided including mounting a textile on a platen, digitally printing an ink layer in a single pass on the textile; and curing the ink layer.

In one embodiment, the digital printing is performed by an inkjet printer.

Further according to an embodiment of the present invention there is a device for printing on the textile. The device includes a platen for holding a textile piece; at least two print heads above the textile piece for applying an image and a controller wherein the controller manipulates the at least two print heads.

In one embodiment of the present invention, there are at least four print heads.

Other and further features and advantages of the present invention will be apparent from the following descriptions of the various embodiments. It will be understood by one of ordinary skill in the art that the following embodiments are provided for illustrative and exemplary purposes only, and that numerous combinations of the elements of the various embodiments of the present invention are possible.

BRIEF DESCRIPTION OF THE PREFERRED EMBODIMENTS OF THE INVENTION

DETAILED DESCRIPTION OF PREFERRED EMBODIMENTS OF THE INVENTION

Various embodiments of the invention are described hereinafter. The embodiments are not intended as an exhaustive description of the invention or as a limitation on the scope of the invention. In addition, an aspect described in conjunction with a particular embodiment of the invention is not necessarily limited to that embodiment and can be practiced in any other embodiment of the invention.

Embodiments of the present invention relate to systems and methods for direct printing of an image on a textile. In particular, the embodiments relate to novel systems and methods for direct to garment/textile image printing accomplished in a single pass using digital methods. The invention is equally applicable to printing on light or white textiles as well as colored or dark textiles.

Direct to garment printing is a relatively new process that has generally been used to print images where only small quantities of textiles are being processed. Traditionally, large textile print jobs are performed using conventional silk screen methods or image transfer methods. The latter method is less desirable as images often lose resolution and clarity. Current direct to garment printing techniques require the print head to make more than one pass over the image area in order to print the image on the textile. Common commercially available print heads are too narrow to print garments in a single pass. A platen is placed under the area of the textile that is to receive the image. The platen area also represents the maximum print area. A print head is positioned above a portion of the proposed image print area. The print head contains multiple nozzles. Although depicted as having eleven nozzles, this is not intended to be a limitation on the number of nozzles in the print head. Generally there are numerous nozzles. In addition, there may be multiple rows of nozzles, the nozzles may also be randomly placed and/or nozzles may be located on the perimeter of the print head. As is known to those of skill in the art, coupled to each nozzle is a hose. Further, as is known in the art, coupled to each hose is a cartridge or bottle of ink. The print head is mounted on a controller arm such that the print head may move along both an x-axis and a y-axis parallel to the textile. In this printing method, the print head is required to make multiple passes to print the entire image. The need for multiple passes is due to the shortness of the length of the print head. Larger print heads have previously been unsatisfactory for creating an image in a single pass. Larger print heads historically lack fine resolution and great enough width and therefore are not as useful in direct to garment printing.

Figure 1:
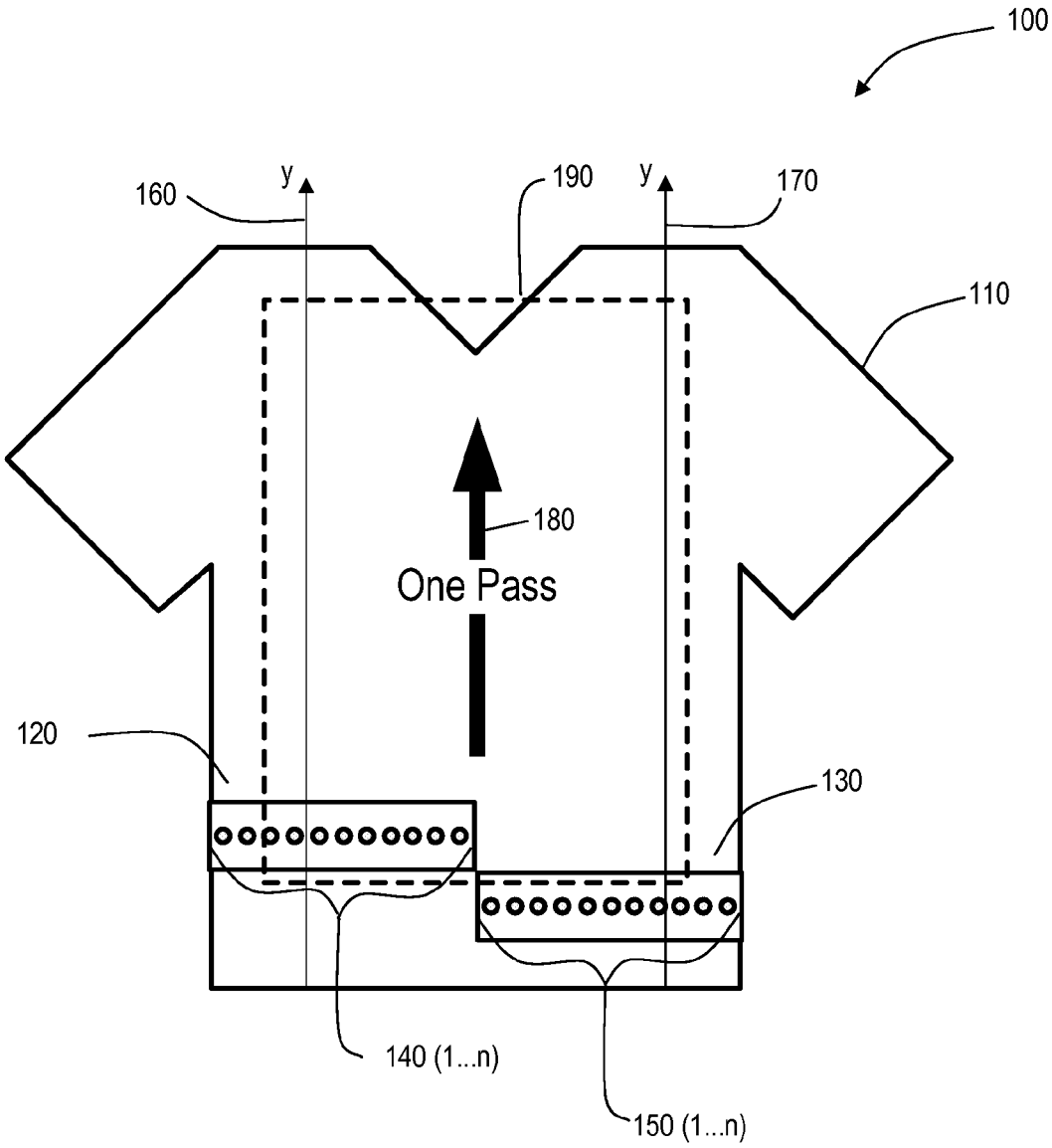
FIG. 1 is a plan view of a multi-head textile printer.

Direct to garment printing is highly desirable because it creates a sharp image. However, the process is time consuming and therefore less desirable for use on large textile printing jobs. In addition, because ink nozzles can become clogged or a cartridge may run out of ink, print jobs may be interrupted. When an ink cartridge must be changed or a nozzle clogs, the textile that is currently being printed on is usually scrapped because the image becomes distorted or damaged when the system is restored to operating condition. FIG. 1 illustrates a novel approach for printing on a textile 100. A platen, shown by the dashed rectangle 190, is placed under the area of the textile 110 that is to receive the image. The platen area also represents the maximum print area. At least two print heads 120, 130 are placed above a portion of the proposed image print area. The at least two print heads are placed in a horizontal arrangement across the textile 110. Although shown as rectangles print heads of any shape or size are contemplated within the scope of the present invention. Furthermore, while it is preferable to have rectangular shaped print heads arranged horizontally, other arrangements of the print heads are contemplated within the scope of the present invention. The at least two print heads 120, 130 each contain multiple nozzles 140 (1 . . . *n*), 150 (1 . . . *n*). Although depicted as having eleven nozzles 140 (1 . . . *n*), 150 (1 . . . *n*) this is not intended to be a limitation on the number of nozzles 140 (1 . . . *n*), 150 (1 . . . *n*) in the print heads. Generally there are numerous nozzles. Preferably there are hundreds of nozzles but there may also be thousands of nozzles. In addition, there may be multiple rows of nozzles, the nozzles may also be randomly placed, and/or the nozzles may be located on the perimeter of the print heads 120, 130. As is known to those of skill in the art, coupled to each nozzle is a hose (not shown). Further, as is known in the art, coupled to each hose is a cartridge or bottle of ink (not shown). The print heads 120, 130 are mounted on a controller arm (not shown) such that the print heads 120, 130 may each move along its own y-axis 160, 170 parallel to the textile 110. While depicted as straight lines, the y-axes could be a curved axis or any other geometric outline on which the print heads could progress. The print heads 120, 130 therefore work together making a single pass 180 to print the entire image. Although shown as having two print heads 120, 130 in an array, other quantities of print heads are contemplated within the scope of the present invention. Additional print heads may be utilized for example, when larger images are to be printed. As shown the print heads are arranged in two across. Preferably, the number of print heads is a multiple of two. This novel approach provides for two or more print heads to be manipulated simultaneously by a single controller. Although less desirable, it is also contemplated within the scope of the present invention that the print heads could be manipulated individually and/or multiple controllers could be employed.

While FIG. 1 illustrates the at least two print heads in a horizontal arrangement, the at least two prints heads could be of sufficient size that an image could be constructed in a single pass with the at least two print heads arranged in vertical alignment with one another. If the at least two print heads are arranged along a vertical axis, then only a single axis along which the at least two print heads move is necessary. In this alternate embodiment, the at least two print heads cooperate as described below in conjunction with FIG. 2 to create an image.

In another embodiment, the platen on which the textile is mounted moves along an axis, either vertical, horizontal or both to create an image while the print head remains stationary. In this embodiment the movement of the platen is manipulated by a controller.

Figure 2:
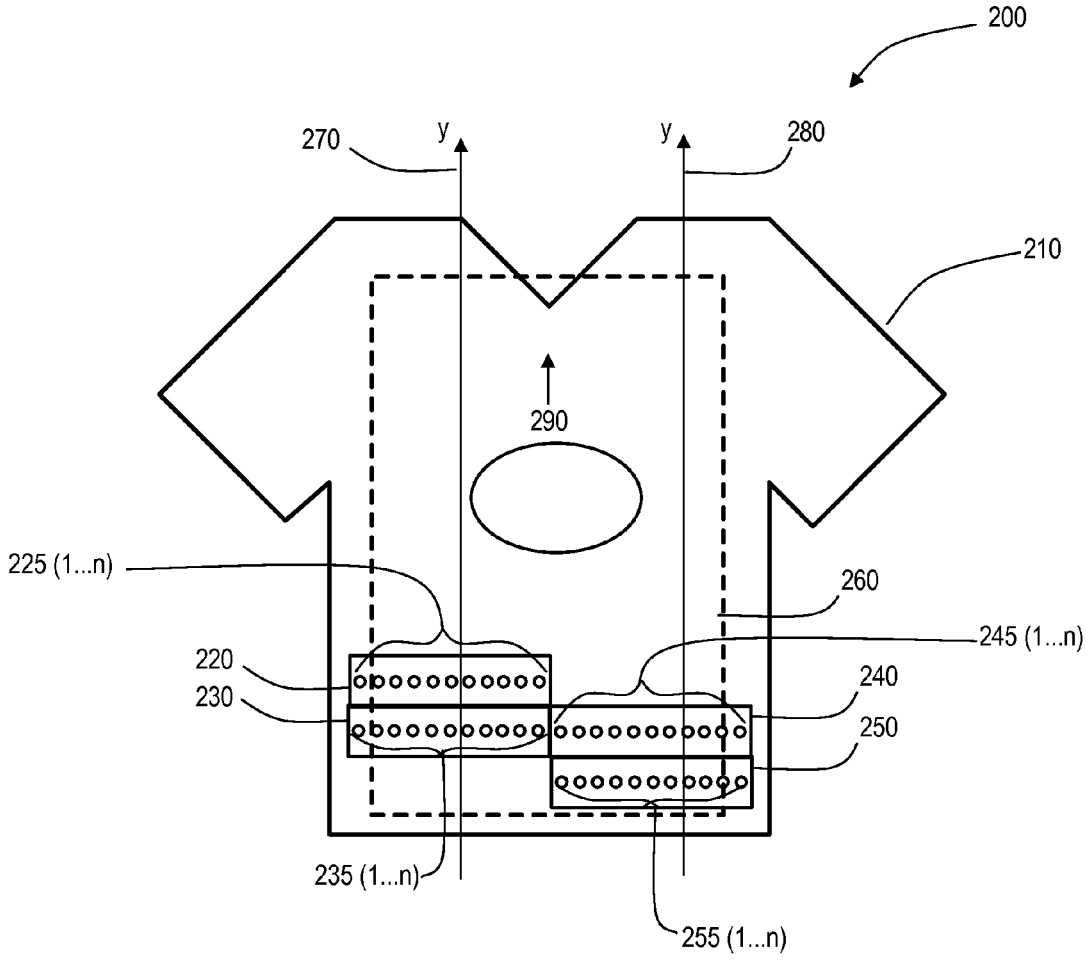
FIG. 2 is a plan view of a multi-array, multi-head textile printer.

An embodiment 200 of more than two print heads across is depicted in FIG. 2. A platen, shown by the dashed rectangle 260, is placed under the area of the textile 210 that is to receive the image. The platen area also represents the maximum print area. Four print heads 220, 230, 240, 250 are placed above a portion of the proposed image print area. The print heads 220, 230, 240, 250 are placed in a pairs and in a horizontal arrangement across the textile 210. Each pair 220, 230, 240, 250 are arranged such that the long side of the first print head of the pair 220, 240 abuts the long side of the second print head print of the pair 230, 250 respectively. Each print head 220, 230, 240, 250 contains multiple nozzles 225 (1 . . . *n*), 235 (1 . . . *n*), 245 (1 . . . *n*), 255 (1 . . . *n*). Although depicted as having eleven nozzles 225 (1 . . . *n*), 235 (1 . . . *n*), 245 (1 . . . *n*), 255 (1 . . . *n*) this is not intended to be a limitation on the number of nozzles 225 (1 . . . *n*), 235 (1 . . . *n*), 245 (1 . . . *n*), 255 (1 . . . *n*) in the print heads. Generally there numerous nozzles. In addition, there may be multiple rows of nozzles, the nozzles may also be randomly placed, and/or the nozzles may be located on the perimeter of the print heads 220, 230, 240, 250. Furthermore, the nozzles could be arranged in the same pattern on each print head, in varying patterns on each print head or in any combination of patterns as suited for the printing purpose. As is known to those of skill in the art, coupled to each nozzle is a hose (not shown). Further, as is known in the art, coupled to each hose is a cartridge or bottle of ink (not shown). The print heads 220, 230, 240, 250 are mounted on a controller arm (not shown) such that the print heads 220, 230, 240, 250 may each move along its own y-axis 270, 280 parallel to the textile 210. Alternatively, the pairs of print heads could be mounted on multiple controller arms that operated independently. Regardless of the controller arm configuration, the print heads 220, 230, 240, 250 work together making a single pass 290 to print the entire image.

By having multiple heads, an image can be printed in a single pass allowing for greater efficiency. In addition, printing in one pass, reduces the likelihood of distortion from potential movement of the textile or misalignment of the print head(s). Furthermore, when multiple arrays of print heads are employed in vertical alignment with one another, the ink bottles or cartridges can be changed during the print process without requiring the process to be paused. The second array of heads can take over printing when the ink has run out of the first or vice versa. Furthermore, if a nozzle on one print head clogs, the printing can be completed by the second array of nozzles in the print head adjacent to the print head containing the clogged nozzle. This is possible as the second print head may operate as a redundant print head.

In one embodiment, the process for printing an image on a textile begins by mounting a textile on a platen. The textile is then placed beneath at least two print heads that digitally print an ink layer in a single pass on the textile. The ink is then cured. A curing unit may be included on the device performing the printing, or the curing may be done by a separate device. One of skill in the art will appreciate that each ink jet print head may be connected to multiple ink cartridges or bottles of the same or different colors.

Whether the curing unit is incorporated into the printing device, or is a separate device the curing may be accomplished in any conventional manner, such as UV curing lamp, infrared, hot air, or baking or hot melt solidification depending on the ink and application. The ink is cured to prevent bleeding if a second image is over printed and also to set the image so that it is durable and does not dissolve upon cleaning of the textile.

In a preferred embodiment, a controller controls the process of applying the ink as well as the curing process after the application of the ink.

The "construction" of the image is achieved by placing ink drops at different adjacent sites as discreet, physically non-mixed drops using customary printing methods. The image is printed by an array of printing heads. If full color is desired, the image is printed using the traditional subtractive primary colors: Cyan, Yellow, Magenta, and Black. The use of a variety of types of ink is contemplated within the scope of the invention.

In one embodiment a system for direct to garment/textile printing on a textile in a single pass is also disclosed. The system includes a platen for holding a textile piece (also contemplated within the scope if the present invention is the use of a printing table in place of the platen), at least two inkjet print heads located directly above the textile piece for applying an ink layer. The print heads include an array of nozzles to dispense the ink. The ink dispense may be a single color or multiple colors. Preferably the apparatus includes a curing unit located above the textile piece. A controller is coupled to the system. The controller manipulates the at least two ink jet heads for applying the ink layer and the curing unit if such is included with the system. Alternatively the curing unit could be a separate device or a printed image could dry and cure by itself with time.

The controller, in addition to manipulating the application and flow of the ink, also causes the print head to move along a y-axis parallel to the textile in order to create the image. Alternatively, if a platen is used, the platen could be manipulated by the controller causing the textile to move and thereby create the image instead of the print head.

As noted previously the forgoing descriptions of the specific embodiments are presented for purposes of illustration and description. They are not intended to be exhaustive or to limit the invention to the precise forms disclosed and obviously many modifications and variations are possible in view of the above teachings. The embodiments were chosen and described in order to explain the principles of the invention and its practical applications, to thereby enable those skilled in the art to best utilize the invention and various embodiments thereof as suited to the particular use contemplated. It is intended that the scope of the invention be defined by the following claims and their equivalents.

The invention claimed is:

1. A method for direct to garment printing comprising:
mounting a textile on a platen;
disposing at least two print heads having multiple nozzles above the textile wherein the at least two print heads are positioned to provide coverage that spans the width of an area of the textile that is to receive a wide-format image, wherein the wide-format image is an image wider than the width of a print head; and
printing the wide-format image on the textile, wherein the printing step comprises moving each of the print heads in no more than one direction in a single pass along a y-axis parallel to the garment and dispensing ink from the multiple nozzles.

2. The method of claim 1, further comprising curing the printed image.

3. The method of claim 1, wherein printing the image is performed by a controller manipulating the at least two print heads.

4. The method of claim 3, wherein the printed image is cured by a curing unit.

5. The method of claim 4, wherein the curing unit is manipulated by the controller.

6. The method of claim 1, wherein the at least two print heads are ink jet print heads.

7. A system for direct to garment printing comprising:
a platen for holding a textile piece;
at least two print heads disposed directly above the platen for holding the textile piece, wherein the at least two print heads are positioned to provide coverage that spans the width of an area of the textile that is to receive a wide-format image, wherein the wide-format image is an image wider than the width of a print head;
at least two y-axes along which the at least two print heads progress; and
an array of nozzles contained within each of the at least two print heads for dispensing an ink layer to create a wide-format image, wherein the dispensing comprises moving each of the at least two print heads in no more than one direction in a single pass along the y-axes parallel to the garment.

8. The system of claim 7, further comprising a controller to manipulate the at least two inkjet print heads.

9. The system of claim 8, further comprising a curing unit located above the textile piece.

10. The system of claim 9, wherein the controller manipulates the curing unit.

11. The system of claim 7, wherein the at least two print heads are inkjet print heads.

12. The system of claim 7, wherein the at least two prints heads comprise a pair of print heads each.

13. A method for direct to garment printing comprising:
mounting a textile on a platen;
disposing at least two sets of print heads having multiple nozzles above the textile, wherein each set comprises two or more print heads, wherein the at least two sets of print heads are positioned to provide coverage that spans the width of an area of the textile that is to receive a wide-format image, wherein the wide-format image is an image wider than the width of a print head; and
printing the wide-format image on the textile, wherein the printing step comprises moving each of the print heads in no more than one direction in a single pass along a y-axis parallel to the garment and dispensing ink from the multiple nozzles.

14. A method for direct to garment printing comprising:
mounting a textile on a platen;
disposing at least two print heads having multiple nozzles above the textile wherein the at least two print heads are positioned to provide coverage that spans the width of an area of the textile that is to receive a wide-format image, wherein the wide-format image is an image wider than the width of a print head; and
printing the wide-format image on the textile, wherein the printing step comprises dispensing ink from the multiple nozzles as the garment moves in no more than one direction in a single pass along a y-axis under the at least two print heads, wherein the at least two print heads remain stationary.

* * * * *